US010024006B2

(12) United States Patent
Noh et al.

(10) Patent No.: US 10,024,006 B2
(45) Date of Patent: Jul. 17, 2018

(54) ROAD SURFACE CRUSHING APPARATUS

(71) Applicants: Young Choul Song, Hwaseong-si (KR); DB CRUSHER, Gwangju-si (KR)

(72) Inventors: Jeong Bok Noh, Gwangju-si (KR); Young Choul Song, Hwaseong-si (KR)

(73) Assignee: DB CRUSHER, Gwangju-si (KR)

( * ) Notice: Subject to any disclaimer, the term of this patent is extended or adjusted under 35 U.S.C. 154(b) by 0 days.

(21) Appl. No.: 15/720,646

(22) Filed: Sep. 29, 2017

(65) Prior Publication Data

US 2018/0171569 A1 Jun. 21, 2018

(30) Foreign Application Priority Data

Dec. 16, 2016 (KR) ..... 10-2016-0172236

(51) Int. Cl.
*E01C 23/12* (2006.01)
*B28D 1/18* (2006.01)
*E01C 23/088* (2006.01)

(52) U.S. Cl.
CPC ..... *E01C 23/127* (2013.01); *B28D 1/18* (2013.01); *E01C 23/088* (2013.01)

(58) Field of Classification Search
CPC ..... E01C 23/127; E01C 23/088; B28D 1/18
USPC ..... 404/92, 93
See application file for complete search history.

(56) References Cited

U.S. PATENT DOCUMENTS 2,036,598 A * 4/1936 Miller ..... E01C 23/121 172/252
4,175,886 A * 11/1979 Moench ..... E01C 23/121 172/452
4,720,207 A * 1/1988 Salani ..... B28D 1/186 172/123
4,909,575 A * 3/1990 Lupton ..... E01C 23/088 180/24.02
4,971,476 A * 11/1990 Guillon ..... E01C 19/025 404/91
5,851,086 A * 12/1998 Kurasako ..... B60B 39/00 404/124

(Continued)

FOREIGN PATENT DOCUMENTS

JP H07-026508 A 1/1995
JP H11-209921 A 8/1999
KR 10-1530133 B1 6/2015

*Primary Examiner* — Raymond W Addie
(74) *Attorney, Agent, or Firm* — KORUS Patent, LLC; Seong Il Jeong

(57) ABSTRACT

A road surface crushing apparatus includes: a cylinder-shaped drum configured to be rotatably installed on one side of a main transportation means; a plurality of crushing units each formed to protrude from one side of the outer circumferential surface of the drum in an outward direction, and configured to crush a road surface to be repaired; and one or more cutting units each formed to extend from one side of one of both ends of the outer circumferential surface of the drum in a direction away from the outer circumferential surface of the drum, and configured to cut a boundary surface between the road surface to be repaired and a road surface not to be repaired; wherein when the drum is rotated, both a crushing operation of the crushing units and a cutting operation of the cutting units are simultaneously performed.

3 Claims, 2 Drawing Sheets

(56) References Cited

U.S. PATENT DOCUMENTS

| | | | | |
|---|---|---|---|---|
| 6,176,551 | B1 * | 1/2001 | Page | E01C 23/088<br>172/684.5 |
| 8,500,360 | B1 * | 8/2013 | Jones | E01F 9/70<br>256/13.1 |
| 9,422,675 | B2 * | 8/2016 | Bornemann | E01C 19/264 |
| 2015/0184347 | A1 * | 7/2015 | Lantez | E01C 19/23<br>404/124 |

* cited by examiner

ROAD SURFACE CRUSHING APPARATUS

BACKGROUND

1. Technical Field

The present invention relates to a road surface crushing apparatus, and more specifically to a road surface crushing apparatus which is capable of simultaneously performing both an operation of crushing a road surface to be repaired and an operation of cutting a boundary surface between the road surface to be repaired and a road surface not to be repaired.

2. Description of the Related Art

Generally, an asphalt or concrete pavement includes, from the bottom thereof: a ground adapted in the form of a rammed soil layer, i.e., a filled-up layer; a selective material layer formed by stacking and ramming rubbles or large stones on the ground; an auxiliary base layer formed by stacking and ramming smaller crushed stones on the selective material layer; and a pavement layer formed on the auxiliary base layer, and adapted to form a surface layer with which the tires of vehicles, etc., come into direct contact.

Such a pavement suffers from a crack occurring due to a sponge phenomenon attributable to the defective drainage or excessive soil or water content of the auxiliary base layer, and also suffers from a crack in or damage to a road surface, i.e., the pavement layer, occurring due to the successive loads of vehicles which are running on the road.

In this case, generally, in order to reduce the social economic cost and maintain a smooth traffic flow on a road, it is typical practice to remove a road surface to be repaired, which is defined by a road surface of a specific width including a damaged portion, and then re-pave the road surface to be repaired.

Korean Patent No. 10-1611493 discloses a road surface crushing device which crushes a road surface to be repaired by using a crushing drum including a cylinder-shaped drum body configured to be installed on one side of a vehicle for work, and a plurality of crushing bits each configured to protrude from one side of the outer circumferential surface of the drum body.

However, the road surface crushing device disclosed in Korean Patent No. 10-1611493 crushes a road surface to be repaired only by means of the crushing bits formed on the outer circumferential surface of the drum body and then removes the road surface to be repaired, and thus a boundary surface between the road surface to be repaired and a road surface not to be repaired is formed to be irregular.

Accordingly, the boundary region of the road surface to be repaired is not appropriately filled with a repair material, and thus a problem occurs in that a construction defect, such as a crack, deflection, or the like, occurs due to the inappropriate ramming of the repair material during ramming operation.

Accordingly, recently, there has been used a method in which a boundary surface between a road surface to be repaired and a road surface not to be repaired is cut using a separate cutting device, and the road surface to be repaired is crushed using a crushing device and removed. However, this method is problematic in that repairing time is considerably increased because a cutting operation and a crushing operation are separately performed, and is also problematic in that repairing cost is considerably increased because equipment and personnel are additionally required for the cutting operation and the crushing operation.

PRIOR ART DOCUMENT

Patent Document (Patent document 1) Korean Patent No. 10-1530133 entitled "Road Surface Crusher for Skid Loader"

SUMMARY

The present invention has been conceived to overcome the above-described problems, and an object of the present invention is to provide a road surface crushing apparatus which is capable of simultaneously performing both an operation of crushing a road surface to be repaired and an operation of cutting a boundary surface between the road surface to be repaired and a road surface not to be repaired.

In order to achieve the above-described object, there is provided a road surface crushing apparatus, including: a cylinder-shaped drum configured to be rotatably installed on one side of a main transportation means; a plurality of crushing units each formed to protrude from one side of the outer circumferential surface of the drum in an outward direction, and configured to crush a road surface to be repaired; and one or more cutting units each formed to extend from one side of any one of both ends of the outer circumferential surface of the drum in a direction away from the outer circumferential surface of the drum, and configured to cut a boundary surface between the road surface to be repaired and a road surface not to be repaired; wherein when the drum is rotated, both a crushing operation of the crushing units and a cutting operation of the cutting units are simultaneously performed.

Each of the cutting units may be formed in a disk shape, may be coupled to any one of both ends of the drum, and may include a cutting blade configured to cut the boundary surface between the road surface to be repaired and the road surface not to be repaired.

Each of the cutting units may further include: an inner flange formed in a disk shape, coupled to any one of both ends of the drum, and configured to support one surface of the cutting blade; an outer flange formed in a disk shape, and configured to be supported on the other surface of the cutting blade; and a fastening means configured to fasten the outer flange and the cutting blade onto the inner flange.

The inner flange may include an inclined surface formed around the inner circumference thereof in the circumferential direction thereof.

The fastening means may include a fastening bolt, including a fastening portion configured to be fastened to one side of the inner flange through one side of the outer flange and one side of the cutting blade, and a head portion configured to have a diameter larger than that of the fastening portion and to be supported on one side of the outer flange; one or more fastening holes each configured to receive the fastening means may be formed through one side of the cutting blade and one side of the outer flange; and each of the fastening holes may include a reception hole portion formed to have a diameter identical to that of the head portion, and an elongated hole portion configured to extend from the reception hole portion to a height identical to the diameter of the fastening portion in a rotation direction.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

The present invention will be described in greater detail below with reference to the accompanying drawings. It should be noted that throughout the drawings, the same components will be designated by the same reference symbols as much as possible. Furthermore, detailed descriptions of well-known functions and configurations which may unnecessarily make the gist of invention vague will be omitted.

Figure 1:
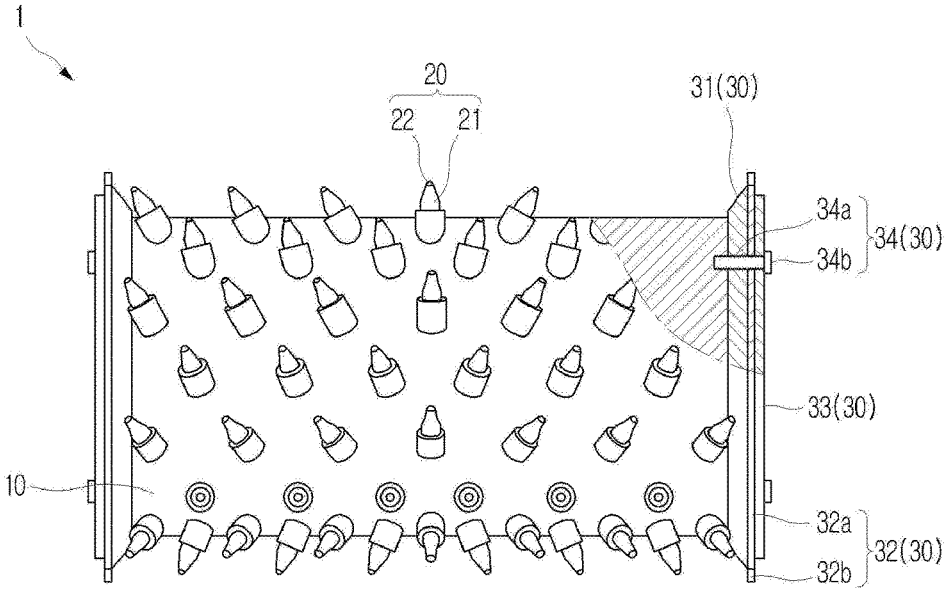
FIG. 1 is a partially sectional view showing a road surface crushing apparatus according to an embodiment of the present invention.
Figure 2:
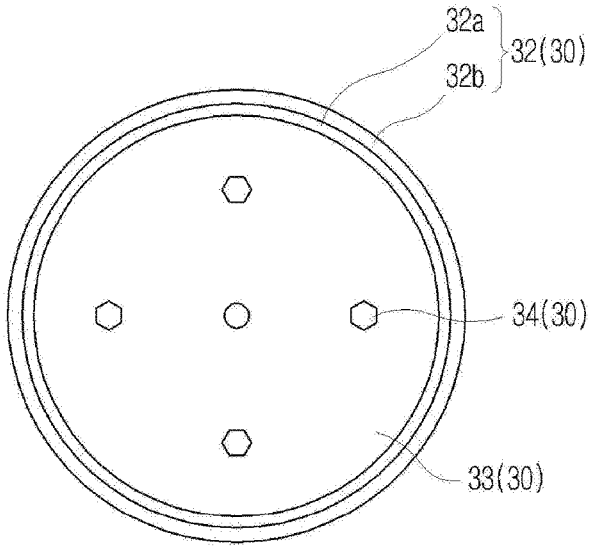
FIG. 2 is a side view showing the road surface crushing apparatus according to the embodiment of the present invention.

FIG. 1 is a partially sectional view showing a road surface crushing apparatus 1 according to an embodiment of the present invention, and FIG. 2 is a side view showing the road surface crushing apparatus 1 according to the embodiment of the present invention.

Referring to FIGS. 1 and 2, the road surface crushing apparatus 1 according to the embodiment of the present invention includes a drum 10, a plurality of crushing units 20, and one or more cutting units 30.

The drum 10 is formed in a cylindrical shape, is rotatably coupled to one side of a main transportation means, is rotated via a separate drive unit in a direction in which the main transportation means moves, and provides spaces for the installation of the crushing units 20 and the cutting units 30 to be described below.

In this case, the main transportation means may be a vehicle, or a small-sized transportation apparatus which is driven through the manipulation of a steering wheel by an operator.

The plurality of crushing units 20 protrudes from the outer circumferential surface of the drum 10 in a direction away from the outer circumferential surface of the drum 10 at regular intervals in the widthwise and outer circumferential directions of the drum 10, and functions to crush a road surface to be repaired when the drum 10 is rotated.

In this case, each of the crushing units 20 includes a body 21 configured to include a cone-shaped front end portion protruding from the outer circumferential surface of the drum 10, and a tip 22 coupled to the front end of the body 21. Since the crushing units 20 correspond to a well-known or commonly used technology which is well known to those having ordinary knowledge in the art, a detailed description thereof is omitted.

Each of the cutting units 30 extends from one of both ends of the outer circumferential surface of the drum 10 in a direction away from the outer circumferential surface of the drum 10, and functions to cut a boundary surface between a road surface to be repaired and a road surface not to be repaired when the drum 10 is rotated. The cutting unit 30 includes an inner flange 31, a cutting blade 32, an outer flange 33, and a fastening means 34.

The inner flange 31 is formed in a disk shape, is coupled to one of both ends of the drum 10, and provides an area configured to support the one surface cutting blade 32 to be described later.

Since the inner flange 31 supports one surface of the cutting blade 32, the cutting blade 32 is prevented from being bent in the inner direction of the drum 10 during operation. Accordingly, the inner flange 31 functions to support the cutting blade 32 so that a boundary surface between a road surface to be repaired and a road surface not to be repaired can be accurately cut by the cutting blade 32, and also functions to prevent the cutting blade 32 from being damaged by bending.

Furthermore, the inner flange 31 has an inclined surface which is formed around the inner circumference thereof in the circumferential direction thereof.

This inclined surface functions to prevent the inner flange 31 from interfering with the crushing units 20 which are installed on the outermost side near a corresponding one of both ends of the drum 10.

The cutting blade 32 has a disk shape having a diameter larger than that of the inner flange 31, has one surface supported on the inner flange 31, and functions to cut a boundary surface between a road surface to be repaired and a road surface not to be repaired when the drum 10 is rotated.

The cutting blade 32 includes a disk-shaped blade body 32*a* configured to have the same diameter as the inner flange 31, and a cutting edge 32*b* configured to extend around the circumference of the blade body 32*a* in the circumferential direction of the blade body 32*a*.

Meanwhile, a problem may occur in that the blade body 32*a* is easily bent in the direction of the inner flange 31 by soil pressure applied form a boundary surface between a road surface to be repaired and a road surface not to be repaired during cutting operation. According to the present invention, the blade body 32*a* is configured to have the same diameter as the inner flange 31, and thus the cutting blade 32 can be reliably prevented from being bent in the direction of the inner flange 31 during operation.

Furthermore, the cutting edge 32*b* may be made of a diamond material, a cubic boron nitride (CBN) alloy material in which CBN particles are distributed, a cemented carbide material in which tungsten carbide (WC) particles are distributed, or a super-alloy material.

The outer flange 33 is formed in a disk shape having a diameter smaller than that of the cutting blade 32, and is supported on the other surface of the cutting blade 32.

Since the outer flange 33 is supported on the other surface of the cutting blade 32, the cutting blade 32 is prevented from being bent in the outer direction of the drum 10 during operation. Accordingly, the outer flange 33 functions to support the cutting blade 32 so that a boundary surface between a road surface to be repaired and a road surface not to be repaired can be accurately cut by the cutting blade 32, and also functions to prevent the cutting blade 32 from being damaged by bending.

The fastening means 34 functions to fasten the outer flange 33 and the cutting blade 32 onto the inner flange 31.

The fastening means 34 includes a fastening portion 34*a* configured to be fastened into one side of the inner flange 31 through one side of the outer flange 33 and one side of the cutting blade 32, and a head portion 34*b* configured to have a diameter larger than that of the fastening portion 34*a* and to be supported on one side of the outer flange 33. The fastening means 34 may be a well-known fastening bolt.

Although in the present embodiment, the cutting blade 32 and the outer flange 33 have been described as being detachably fastened onto the inner flange 31 by the fastening means 34, the present invention is not limited thereto, but the cutting blade 32 and the outer flange 33 are integrated with the inner flange 31 by a method, such as welding, or the like.

As described above, the road surface crushing apparatus 1 according to the embodiment of the present invention additionally includes the cutting units 30 coupled to both ends of the drum 10, and, thus, can simultaneously perform both an operation of crushing a road surface to be repaired and an operation of cutting a boundary surface between the road surface to be repaired and a road surface not to be repaired.

Accordingly, according to the present invention, a boundary surface between the road surface to be repaired and the road surface not to be repaired is accurately cut by the cutting unit 30, and thus the boundary region of the road surface to be repaired is sufficiently filled with a repair material (asphalt or concrete). Accordingly, a construction defect, such as a crack in or the deflection of the boundary region of the road surface to be repaired, resulting from the insufficient ramming of the repair material occurring because the boundary region is not sufficiently filled with the repair material, can be prevented from occurring.

Furthermore, both an operation of crushing the road surface to be repaired and an operation of operation of cutting the boundary surface between the road surface to be repaired and the road surface not to be repaired can be simultaneously performed, and thus the working time required for repairing work can be considerably shortened and the cost required for the repairing work can be also considerably reduced.

Figure 3:
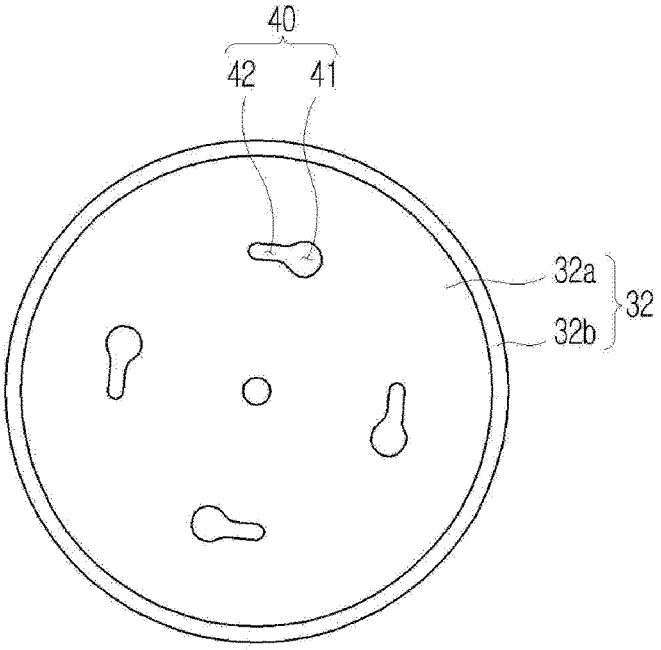
FIG. 3 is a schematic diagram showing a cutting blade according to another embodiment of the present invention.
Figure 4:
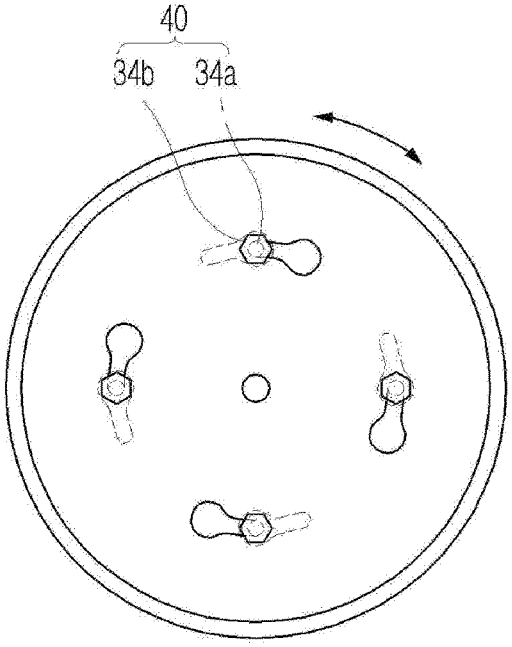
FIG. 4 is a view illustrating an operation of mounting the cutting blade according to the other embodiment of the present invention.

FIG. 3 is a schematic diagram showing a cutting blade 32 according to another embodiment of the present invention, and FIG. 4 is a view illustrating an operation of mounting the cutting blade 32 according to the other embodiment of the present invention.

Meanwhile, there is normally provided a separate safety cover configured to accommodate the road surface crushing apparatus 1 according to the present invention in the state in which the road surface crushing apparatus 1 has been installed on one side of the main transportation means. For this reason, only narrow spaces are formed between the cutting blades 32, mounted at both ends of the road surface crushing apparatus 1, and the safety cover, and thus there occurs difficulty with an operation of mounting and demounting the cutting blades 32 on and from the road surface crushing apparatus 1.

In order to resolve the above problem, the cutting blade 32 according to another embodiment of the present invention includes one or more fastening holes 40 formed through one side thereof and configured to receive the fastening means 34. As shown in FIG. 3, each of the fastening holes 40 includes a reception hole portion 41 configured to have the same diameter as the head portion 34*b*, and an elongated hole portion 42 configured to extend from the reception hole portion 41 to a height identical to the diameter of the fastening portion 34*a* in a rotation direction.

As described above, in the cutting blade 32 according to the other embodiment of the present invention, the fastening holes 40 are each formed in a structure in which the reception hole portion 41 and the elongated hole portion 42 are connected to each other, and thus the cutting blade 32 can be simply mounted on or demounted from the inner flange 31 in the state in which the fastening means 34 have not been completely tightened into or loosened from the inner flange 31, as shown in FIG. 4.

Furthermore, although not shown in the drawings, fastening holes identical to the fastening holes 40 formed in the cutting blade 32 are formed in one side of the outer flange 33 corresponding to the fastening holes 40 formed in the cutting blade 32, and thus the outer flange 33 can be selectively mounted and demounted in the same manner as the cutting blade 32.

According to the above-described present invention, a boundary surface between a road surface to be repaired and a road surface not to be repaired is accurately cut, and thus the boundary region of the road surface to be repaired is sufficiently filled with a repair material (asphalt or concrete). Accordingly, a construction defect, such as a crack in or the deflection of the boundary region of the road surface to be repaired, resulting from the insufficient ramming of the repair material occurring because the boundary region is not sufficiently filled with the repair material, can be prevented from occurring.

Furthermore, both an operation of crushing the road surface to be repaired and an operation of cutting a boundary surface between the road surface to be repaired and a road surface not to be repaired can be simultaneously performed, and thus the working time required for repairing work can be considerably shortened and the cost required for the repairing work can be also considerably reduced.

Although the present invention has been described in conjunction with the specific embodiments, various modifications and alterations may be made without departing from the scope and technical spirit of the present invention. Accordingly, such modifications and alterations falling within the scope and technical spirit of the present invention will be included in the attached claims.

What is claimed is:

1. A road surface crushing apparatus, comprising:

a cylinder-shaped drum configured to be rotatably installed on one side of a main transportation means;

a plurality of crushing units each formed to protrude from one side of an outer circumferential surface of the drum in an outward direction, and configured to crush a road surface to be repaired; and one or more cutting units each formed to extend from one side of any one of both ends of the outer circumferential surface of the drum in a direction away from the outer circumferential surface of the drum, and configured to cut a boundary surface between the road surface to be repaired and a road surface not to be repaired;

wherein when the drum is rotated, both a crushing operation of the crushing units and a cutting operation of the cutting units are simultaneously performed, wherein each of the cutting units is formed in a disk shape, is coupled to any one of both ends of the drum, and comprises a cutting blade configured to cut the boundary surface between the road surface to be repaired and the road surface not to be repaired, wherein each of the cutting units further comprises:

an inner flange formed in a disk shape, coupled to any one of both ends of the drum, and configured to support one surface of the cutting blade;

an outer flange formed in a disk shape, and configured to be supported on a remaining surface of the cutting blade; and a fastening means configured to fasten the outer flange and the cutting blade onto the inner flange.

2. The road surface crushing apparatus of claim 1, wherein the inner flange comprises an inclined surface formed around an inner circumference thereof in a circumferential direction thereof.

3. The road surface crushing apparatus of claim 1, wherein:

the fastening means comprises a fastening bolt, including a fastening portion configured to be fastened to one side of the inner flange through one side of the outer flange and one side of the cutting blade, and a head portion configured to have a diameter larger than that of the fastening portion and to be supported on one side of the outer flange;

one or more fastening holes configured to receive the fastening means are formed through one side of the cutting blade and one side of the outer flange; and each of the fastening holes comprises a reception hole portion formed to have a diameter identical to that of the head portion, and an elongated hole portion configured to extend from the reception hole portion to a height identical to the diameter of the fastening portion in a rotation direction.

* * * * *